United States Patent [19]

Mahieu

[11] 4,205,295

[45] May 27, 1980

[54] HIGH CONTINUOUS CURRENT CAPACITY OIL EXPULSION FUSE

[76] Inventor: William R. Mahieu, Rt. 4, Centralia, Mo. 65240

[21] Appl. No.: 951,250

[22] Filed: Oct. 13, 1978

Related U.S. Application Data

[63] Continuation-in-part of Ser. No. 837,992, Sep. 29, 1977, abandoned.

[51] Int. Cl.[2] ..... H01H 85/14; H01H 85/02

[52] U.S. Cl. ..... 337/250; 337/203; 337/204

[58] Field of Search ..... 337/250, 278, 279, 280, 337/229, 237, 246, 249, 281, 282, 203, 204

[56] References Cited

U.S. PATENT DOCUMENTS

| | | | |
|---|---|---|---|
| 2,156,058 | 4/1939 | Lohausen | 337/249 |
| 2,291,341 | 7/1942 | Lincks | 337/249 |
| 4,041,434 | 8/1977 | Jacobs et al. | 337/204 |

*Primary Examiner*—Harold Broome

*Attorney, Agent, or Firm*—Schmidt, Johnson, Hovey & Williams

[57] ABSTRACT

An oil expulsion fuse has multiple rupture-resistant fuse wire arc bores for providing fault current protection in high voltage distribution circuits in the 25-35 KV range. In preferred forms, the fuse has a Teflon core defining three discrete, small diameter cylindrical bores, each containing a respective fuse wire, whereby sufficient deionizing gas flow is generated upon fusing of the wires to effectively extinguish arcs formed in the bores, even in the face of high recovery voltage rates associated with distribution voltages above 15 KV. The multiple bores communicate with common chambers at respective ends thereof which are vented to allow connective oil flow through the fuse during normal operation. One chamber has a larger effective vent area than the other and the chambers at opposite ends of the fuse intercommunicate so that upon sequential melting of the fuse wires which occurs during fault interruption, the greater resistance to gas expulsion at one end of the fuse than the other causes gas to be directed down through the bores to prevent arc restrike.

13 Claims, 7 Drawing Figures

HIGH CONTINUOUS CURRENT CAPACITY OIL EXPULSION FUSE

This is a Continuation-in-Part of Application Ser. No. 837,992, Filed Sept. 29, 1977, now abandoned.

BACKGROUND

This invention relates to high voltage distribution circuit oil expulsion fuses in general and more particularly, it is concerned with a fuse of this variety which as compared with a single bore fuse of the same element material and cross sectional area has greater ampacity as well as improved arc-quenching capability, greater ability to interrupt against high rates of rise of transient recovery voltage and to withstand the normal frequency recovery voltage indefinitely without arcing restrikes.

Oil expulsion fuses have long been used in distribution circuits to protect electrical equipment from the deleterious effects of fault currents. Such fuses typically comprise a tubular fuse cartridge having conductive terminal caps at opposed ends, and adapted to receive a single expendable fuse link comprising an elongate fusible element contained within one arc tube. When an overcurrent or fault current is experienced in the circuit containing the fuse, the fusible element is caused to melt, whereupon arcing occurs within the arc tube between the severed segments of the fusible element. Heat produced by the arc vaporizes oil filling the tube producing pressurized deionizing gas therefrom which vents at opposite ends of the fuse cartridge. As the oil derived venting gases flow past the arc, they serve to cool and deionize the latter such that the arc is effectively extinguished. The disabled fuse may subsequently be returned to service by simply replacing the expendable fuse link contained within the fuse cartridge.

While oil expulsion fuses have heretofore generally proven satisfactory for use in distribution circuits, it has been found that there are some difficulties associated with their use in high voltage applications. With single bore oil expulsion fuses, problems have been encountered in attempting to interrupt a low fault current against a high rate of rise recovery voltage. This difficulty occurs over a wide range of application voltages. In this regard, it has been discovered that when conventional oil expulsion fuses are constructed to provide the required current capacity for use in the higher distribution voltage circuits, the fuses do not reliably interrupt against higher transient recovery voltage rates associated with the higher distribution voltages. Of course, this is a highly undesirable characteristic since it represents a failure to clear the overcurrent and could result in serious damage to electrical apparatus relying upon the fuse for current protection. While it has not been conclusively determined why larger conventional oil expulsion fuses are not adapted for use in high voltage distribution circuits, one theory is that the larger internal diameter of the arcing tube required to accomodate the desired ampacity fuse element, precludes development of deionizing gas flow sufficient to adequately extinguish the arc against the higher transient recovery voltages. In any event, there simply is not commercially available a high ampacity refusible oil expulsion fuse capable of reliably interrupting a wide range of fault currents or harmful overcurrents. It has now been discovered that these interruption and restrike problems can be avoided by using a multiple fusible element design with each fusible component received within a separate relatively small diameter fuse bore and wherein gases generated during arcing are controlled to assure interruption without restrike.

While certain types of multiple fusible element expulsion fuse units have been proposed, such as those shown in U.S. Pat. Nos. 2,156,058 to Lohausen and 2,291,341 to Lincks, these have of necessity been restricted to use in air. These air environment devices have no practical application in connection with fusing in oil because they are incapable of allowing connective flow of oil therethrough. Both of the patents identified show an expulsion fuse having a plurality of fusible elements, each element being provided with its own arcing chamber. While these fuses may exhibit limited increased current-carrying capacity for air applications, it is manifest that neither can be used in an oil system. The apparent difficulty in Lohausen's fuse of clearing all of the tubes of residual metal even though arcing occurred in only one or a limited number of bores upon interruption was recognized by Linck who sought to solve the problem with mechanical contrivances in the nature of ejector springs for the fusible elements of each bore. Even this device though would have a limited unfavorably retarded response time with the arc being retained for an undesirable period especially during low current faults.

SUMMARY

The instant invention presents an oil expulsion fuse suitable for use in high voltage distribution circuits by virtue of the provision of multiple fuse wires each disposed within a discrete, rupture-resistant bore such that a selected fuse has the required ampacity as well as exhibits arc-extinguishing capability sufficient to overcome the transient recovery voltage rates associated with the interruption of high voltage circuits for that particular application. More specifically, the fuse includes a synthetic resin, rod-like insert having three elongate, cylindrical bores formed therein, each bore being sufficiently small in diameter to establish a flow rate of deionized gas adequate to extinguish arcs formed within the bore upon melting of fuse wire carried therewithin.

Though each of the fuse wires is substantially identical in size and material to others in the fuse, inherent material and physical differences assure sequential fusing of the wires and arcing in the chambers such that the over current is cleared within the last chamber to arc. Expansion chambers common to all bores are located at both ends of the fuse and communicating with the surrounding oil environment. One of these expansion chambers has a more restricted flow relief area which causes it to vent to ambient more slowly and therefore develop a higher pressure than the opposite expansion chamber. This pressure difference causes a flow of oil and gases down the bores containing the first elements to melt, which did not experience sufficient arcing to clean themselves of melted element metal.

The synthetic resin insert is adapted to be complementally received within a rigid tubular fuse cartridge such that the latter provides additional strength to protect against rupturing of the fuse wire chambers. The chambers at opposite ends of the bores are in part defined by threaded fittings which not only permit oil flow into the elongate bores and gas venting therefrom, but also at the same time preclude expulsion of the insert when overcurrents are encountered.

Convective heat transfer from the fuse wires to the surrounding oil in the respective chambers is responsible for an increase in the current-carrying capacity per unit cross-section of the present invention over single element oil expulsion fuses. Thus, the multiple wire design provides desired ampacity while also permitting the provision of a number of wholly separate fuse chambers each of a sufficiently small diameter to assure proper clearing of fault currents notwithstanding the higher transient voltage recovery rates associated with high voltage distribution circuits.

DETAILED DESCRIPTION OF THE DRAWING

DETAILED DESCRIPTION

Figures 1, 2, 3, 4, 5, 6, 7:
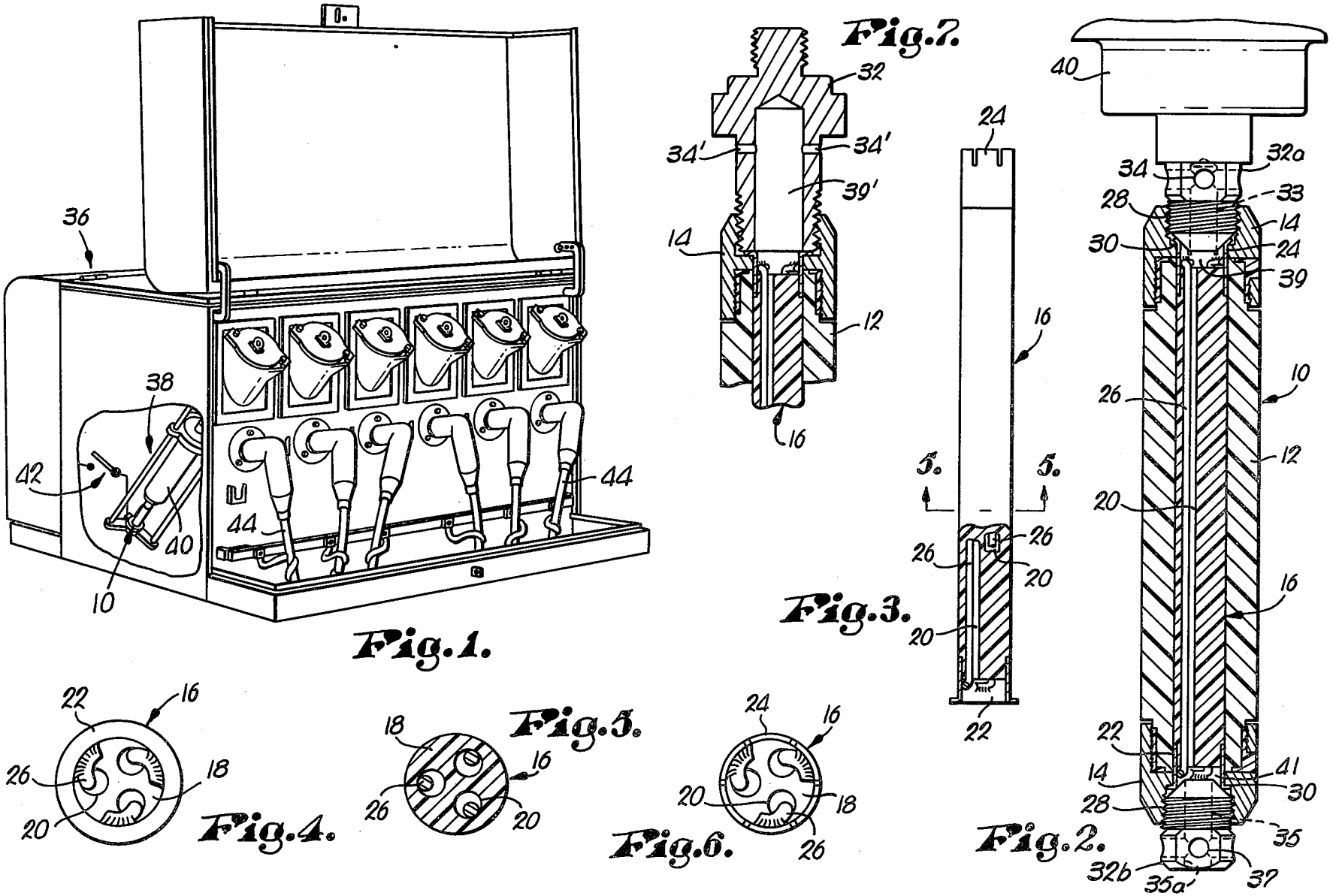
FIG. 1 is a perspective view of a pad mounted double fused vacuum switchgear of the type described in co-owned patent application Ser. No. 640,916, filed Dec. 15, 1975.
FIG. 2 is a longitudinal cross-sectional view of a high continuous current capacity oil expulsion fuse constructed in accordance with the principles of the present invention.
FIG. 3 is an elevational view, with portions shown in cross-section, of the expulsion fuse link which forms a part of the fuse illustrated in FIG. 2.
FIG. 4 is an enlarged bottom end view of the link shown in FIG. 3.
FIG. 5 is an enlarged cross-sectional view taken along line 5—5 of FIG. 3.
FIG. 6 is a top end view of the link shown in FIG. 3.
FIG. 7 is a fragmentary, vertical cross-sectional view of the upper end of the fuse assembly as depicted in FIG. 2, but illustrating a modified form of the invention with more severely restricted flow of oil and gases from the upper end of the fuse during the interruption made thereof.

There is shown in FIG. 2 an oil expulsion fuse 10 comprising a rigid, nonconductive, tubular fuse cartridge 12; a pair of conductive end caps 14 enclosing opposite ends of cartridge 12; and an expulsion fuse link 16 disposed within the cartridge 12 intermediate the caps 14.

The fuse link 16 includes a cylindrical rod-like insert 18 constructed of a synthetic resin material such as a fluorocarbon polymer, preferably polytetrafluoroethylene (Teflon being a specific example), and dimensioned to be complementally received by the cartridge 12. Three cylindrical bores are formed in the insert 18, extending parallel to and symmetrically arranged around the longitudinal axis thereof. The bores 20 are of relatively small diameter in comparison with the diameter of the insert 18; in the preferred embodiment, bores 20 are 0.133 inches in diameter whereas the insert 18 is 0.432 inches in diameter. The insert 18 has secured on opposite ends respectively a flanged metal contact 22 and an opposed slotted contact 24.

As shown in FIG. 5, for example, the bores 20 are positioned within the insert 18 in a manner to maximize the minimum wall thickness of the bores 20. This construction, combined with the inherent strength of the base material for insert 18, renders the chambers 20 substantially non-burstible under the influence of deionizing gas build-up in the respective bores 20 generated upon operation of the fuse 10. Hence, the discrete nature of the bores 20 is at all times maintained, significantly contributing to the ability of the fuse 10 to reliably clear fault currents in high voltage distribution circuits as described hereinbelow.

Respective fuse wires 26 extend through each bores 20 and are secured at opposite ends to the contacts 22, 24 by soldering or other suitable means. In the preferred embodiment, the fuse wires 26 are 0.075 inches in diameter are are comprised of eutectic solid wire solder having a composition of 49.8 percent tin, 32 percent lead, and 18.2 percent cadmium. The fuse wires 26, in combination with their respective chambers 20, define separate current-interrupting links which operate in response to a current of predetermined magnitude.

The end caps 14 are securely coupled with the cartridge 12 in the manner disclosed in my copending application Ser. No. 818,552 entitled EXPULSION FUSE JOINT HAVING SEQUENTIALLY TAPERED ADHESIVE RECEIVING GROOVED SURFACE and which is expressly incorporated herein by reference thereto. Each cap 14 has a central threaded opening 28 extending therethrough including a shoulder 30 adapted to engage a respective contact 22, 24 of the fuse link 16. In this connection, when the link 16 is positioned within the cartridge 12, the flange on contact 22 seats against the shoulder 30 on one of the caps 14 and the slotted contact 24 is deformed in such a manner as to seat against the shoulder 30 of the opposite contact 14. Thus, the fuse link 16 is firmly secured within the cartridge 12 and positive electrical contact is established between the contacts 22, 24 and respective end caps 14.

Each threaded opening on the end caps 14 is adapted to receive a removable, threaded contact plug 32*a* or 32*b* as the case may be whereby the fuse link 16 is positively locked within the cartridge 12. The upper plug 32*a* viewing FIG. 2 has an elongated passage 33 partially therethrough along with four opposed vent parts 34 communicating therewith. The diameter of passage 33 is greater than that of parts 34. The lower plug 32*b* on the other hand has a central passage 35 extending completely through the same and communicating with four vents 37 which are of the same diameter as vents 34, and thus of smaller diameter than passage 35.

It is thus apparent that the passages of the plugs 32, end caps 14 and opposed extremities of insert 18 define respective chambers 39 and 41 which are common to corresponding ends of the bores 20.

Vents 34 and 37 communicating with chambers 39 and 41 allow oil to flow through the bores 20 of insert 18 during the normal continuous current carrying mode of fuse 10. However, chamber 41 has more openings to the surrounding oil media than chamber 39 because of the outlet 35*a* of passage 35.

Referring now to FIG. 1, there is shown a preferred environment of use for the oil expulsion fuse 10 of the present invention. A pad mounted, double fused switchgear 36 has a number of removable fuse assemblies 38 each including an oil expulsion fuse 10 in series combination with a conventional current-limiting fuse 40. The fuse assembly 38 is coupled in series between a switch shown schematically in the drawing and broadly designated 42, and a tap line 44, in a manner well known in this art. Though not shown, the switchgear 36 is provided with a switch 42 and fuse assembly 38 for each of the six tap lines 44 illustrated in FIG. 1. Typically, the housing of the switchgear 36 contains a large reservoir of dielectric liquid, such as mineral transformer oil, the assemblies 38 being submersed in the liquid.

Under normal operating conditions, electrical loads are carried and switched through the switchgear 36, and the distribution current is conducted through the fuse assembly 38. Should a fault current be experienced on the load side of the switchgear 36, the fuse assembly 38 functions to protect both the source and load sides from the overcurrent. In this regard, the current-limiting fuse 40 actuates in response to high level fault currents to quickly clear the fault before damage occurs, while the expulsion fuse 10 clears low range faults by melting of the fuse links 26.

When a low level fault current is experienced in the distribution circuit, the temperature of the fuse wires 26 rises as a result of the increased current. By virtue of the inherent varying cross-sectional thickness of the individual fusible wires, one of the same will tend to melt before the others. When that occurs, although a transitory arc may be produced in that associated bore, the current is then carried by the remaining wires because of the parallel electrical connection. Melting of the second fusible element again results in only minor arcing if any and further concentration of the current in the remaining unmelted fuse wire. When this last fusible element melts, an arc of appreciable extent and time duration is produced thereby producing sufficient gas from ionization of the oil to (1) clean that bore of melted fuse element metal and interrupt the fault current against the transient recovery voltage and (2) equally as important, clean the remaining bores as well of element metal even though they did not significantly arc, and thus preventing an arc restrike which if did occur might not be interrupted because of a deficiency of oil in the bores following current interruption.

Pressure in the chambers 39 and 41 rises rapidly with formation of the deionizing gas such that the latter seeks to vent through the open ends of the chambers. The pressurized deionizing gas flows out of each end of the bore in which the arc has occurred to eject metal and other arc maintaining matter thus effecting extremely rapid suppression and extinguishment of the arc. It is to be noted that the relatively small diameter of each of the bores 20 assures that a suffieient gas flow is established to extinguish virtually any arc formed therein against the higher transient recovery voltage expected at the higher distribution voltages.

Since chamber 41 is able to vent gas more rapidly than chamber 39, a part of the gas directed into chamber 39 is forced to flow through bores 20 toward chamber 41 thus assisting to clean out of the non-arcing bores to effectively eliminate the possibility of arc generation or restrike in these bores when the recovery voltage occurs.

FIG. 7 illustrated a modified form of the invention wherein only two vents 34' are provided in terminal means 32 communicating chamber 39' with the surrounding oil medium to even more severely limit outflow of from chamber 39'. In this case, the vents 34' are also preferably no more than about one fourth of the area of respective vents 34.

The disabled fuse 10 may subsequently be returned to service after replacing the spent fuse link 16. In this regard, assembly 38 is simply removed from the housing of switchgear 36, and the contact plugs 34 are subsequently unscrewed to provide access into the interior of the fuse cartridge 12. Slotted contact 24 is then restraightened such that the spent fuse link 16 may be removed from the cartridge 12 and a new fuse link 16 substituted therefor.

During normal service, the fuse 10 is capable of conducting high continuous currents without melting of the fuse wires 26 such that the fuse assembly 38 is suited for use in heavy service, high voltage distribution circuits. Further in this regard, it is noted that the oil within the housing of switchgear 36 is permitted to flow into the bores 20 through the vent ports 34 and 37. Hence, each of the fuse wires 26 transfers heat by convection transversely or radially to the oil thereby increasing the ampacity of the wires 26. This heat transfer accounts for the fact that the three fuse wires 26 have a greater combined ampacity than a single fuse wire presenting the same cross-sectional area. In other words, the multiple fuse wire design of the present invention results in an increase in ampacity per unit cross-sectional area of the fuse wire over conventional single wire designs.

The increase in ampacity due to the provision of multiple fuse wires, while only negligible in air expulsion fuses, is dramatic in oil expulsion fuses. In actual tests using a 0.075 inch diameter single fuse wire and two 0.050 inch diameter multiple fuse wires, ampacity was shown to increase by only 5 percent in an air expulsion fuse whereas a 30 percent increase in ampacity was realized in an oil expulsion fuse. This startling difference, heretofore unrecognized, may possibly be explained by the different means by which heat is transferred from air fuses as compared with heat transfer from oil fuses. More specifically, heat loss in an air fuse is primarily by axial conduction to the relatively large terminals on opposite ends of the fuse, whereas heat loss in an oil fuse is primarily by transverse or radial convection to the surrounding oil medium. It has been found that the ampacity per unit of fuse element cross-sectional area increases as the fuse element diameter decreases. Thus, the plurality of small diameter fuse elements results in significantly greater ampacity than a single fuse element of similar total cross-sectional area.

It is to be understood that the fuse 10 may be tailored to meet particular service demands by eliminating one or more of the fuse wires 26. In this regard, the ampacity of the tailored fuse 10 is directly proportional to the number of fuse wires 26 utilized (even though the insert 18 may still contain three chambers 20).

From the foregoing, it is clear that the present invention offers a unique expulsion fuse suitable for service in high voltage distribution circuits. The multi-bore design results in increased ampacity as well as provides the fuse with the ability to effectively clear fault currents even against the high transient recovery rates experienced in interrupting high voltage distribution circuits without attendant arcing restrikes.

Having thus described the invention, what is claimed as new and desired to be secured by Letters Patent is:

1. A high voltage distribution circuit expulsion fuse adapted for use while immersed in oil and comprising:

an elongated, non-conductive member having a number of individual, discrete bores extending therethrough, each of which is open at opposite ends thereof;

terminal means at each end of the member presenting corresponding chambers communicating with the open ends of the bores at opposite extremities of the member; and a fusible element within each of the bores and extending along at least a part of the length thereof, each of said fusible elements being electrically connected to opposed terminal means in parallel for flow of electrical current through all of the elements when the fuse is functioning in the normal current carrying mode thereof.

each of said terminal means being provided with vent means therein communicating each of the chambers and thereby the corresponding open ends of the bores with the oil medium surrounding the fuse in normal use thereof whereby convective flow of oil through all of the bores is maintained during said normal current carrying mode of the fuse, the vent means in one of the terminal means being of greater total effective vent area than the corresponding total event area of the vent means in the other terminal means so that upon interruption of a low fault or overload current which causes sequential melting of the elements to occur accompanied by suppression and extinguishment of the arc produced in the bore containing the last to melt element, restrike in any of the bores is effectively precluded when the high rate of rise recovery voltage is imposed on the fuse in that although oil-derived gases generated by arcing of the last to melt element flow through the bore containing such element into both of the chambers, such gas also flows through the other bores from the chamber in said other terminal means toward the chamber in said one terminal means by virtue of the greater resistance to outflow of gases from said other terminal means than said one terminal means.

2. The oil expulsion fuse of claim 1 wherein said terminal means are each provided with at least one opening therein communicating a respective chamber with the surrounding oil in which the fuse is immersed and defining a corresponding vent means, the total effective area of the openings in said one terminal means being greater than that of the openings in the other terminal means.

3. The oil expulsion fuse of claim 2 wherein said one terminal means has a vent opening therein which is axially aligned with the member.

4. The oil expulsion fuse of claim 3 wherein said other terminal means has vent openings therein which is transverse to the longitudinal axis of the member.

5. The oil expulsion fuse of claim 1 wherein is provided an insulative cartridge enclosing said member and means for removably attaching the terminal means to said cartridge at opposite ends thereof to permit replacement of the terminal means as desired for variation of the chamber at each end of the member.

6. The oil expulsion fuse of claim 1, said bores being cylindrical and equal in diameter.

7. The oil expulsion fuse of claim 6 said bores each having a diameter less than 0.150 in.

8. The oil expulsion fuse of claim 7, said elements being substantially equal in diameter and comprised of the same material.

9. The oil expulsion fuse of claim 1, said bores being symmetrically arranged around the longitudinal axis of said member.

10. The oil expulsion fuse of claim 9, there being three of said bores and a corresponding member of said elements.

11. The oil expulsion fuse of claim 1 wherein is provided means replaceably mounting the member and said fusible elements between said terminal means in a manner permitting ready replacement of the member and said elements upon functioning of the fuse to interrupt an overload or fault current.

12. The oil expulsion fuse of claim 1 wherein said member is fabricated of a fluorocarbon polymer.

13. The oil expulsion fuse of claim 12 wherein said polymer is a polytetrafluoroethylene.

* * * * *

UNITED STATES PATENT AND TRADEMARK OFFICE

CERTIFICATE OF CORRECTION

PATENT NO. : 4,205,295

DATED : May 27, 1980

INVENTOR(S) : William R. Mahieu

It is certified that error appears in the above-identified patent and that said Letters Patent are hereby corrected as shown below:

On the front page of the patent document under "[75] Assignee", the following should be added:

Assignee: A.B. Chance Company
Centralia, Mo.

Signed and Sealed this

*Twelfth* Day of *August 1980*

[SEAL]

*Attest:*

SIDNEY A. DIAMOND

*Attesting Officer*

*Commissioner of Patents and Trademarks*